US008113585B2

(12) United States Patent
Fischer

(10) Patent No.: US 8,113,585 B2
(45) Date of Patent: Feb. 14, 2012

(54) ARTICLE OF FURNITURE AND FITTING FOR AN ARTICLE OF FURNITURE

(75) Inventor: Matthias Fischer, Bratislava (SK)

(73) Assignee: Vel Vega—Design e Technologia Ind. Unip. Lda., Funchal, Madeira (PT)

( * ) Notice: Subject to any disclaimer, the term of this patent is extended or adjusted under 35 U.S.C. 154(b) by 0 days.

(21) Appl. No.: 12/806,605

(22) Filed: Aug. 17, 2010

(65) Prior Publication Data

US 2011/0221252 A1 Sep. 15, 2011

Related U.S. Application Data

(63) Continuation of application No. PCT/EP2010/002579, filed on Apr. 27, 2010.

(30) Foreign Application Priority Data

Mar. 9, 2010 (AT) ..... A 376/2010

(51) Int. Cl.
*A47C 7/00* (2006.01)

(52) U.S. Cl. ..... 297/283.1; 297/69; 297/109; 297/118; 297/411.33; 297/411.35; 297/423.1

(58) Field of Classification Search ..... 297/68, 297/69, 110–118, 283.1, 411.33, 411.35, 297/411.37, 411.38, 423.1, 463.1
See application file for complete search history.

(56) References Cited

U.S. PATENT DOCUMENTS

| | | | | |
|---|---|---|---|---|
| 2,716,775 | A * | 9/1955 | Kenimer | 16/357 |
| 5,352,013 | A * | 10/1994 | Rusyniak | 297/119 |
| 5,517,706 | A * | 5/1996 | Kashima et al. | 5/12.1 |
| 6,367,873 | B1 * | 4/2002 | Dorner et al. | 297/110 |
| 7,134,727 | B2 * | 11/2006 | Williams | 297/411.32 |

FOREIGN PATENT DOCUMENTS

| | | | |
|---|---|---|---|
| DE | 203 09 819 | U1 | 10/2003 |
| EP | 0 931 484 | A1 | 7/1999 |
| EP | 1 980 179 | A1 | 10/2008 |

OTHER PUBLICATIONS

Copy of Austrian Patent Office Search Report dated Oct. 10, 2011 for corresponding Austrian Patent Application No. A 376/2010.

* cited by examiner

*Primary Examiner* — Laurie Cranmer
(74) *Attorney, Agent, or Firm* — Flynn, Thiel, Boutell & Tanis, P.C.

(57) ABSTRACT

A hinged fitting for an article of seating furniture, which has a supporting element which is capable of being swung, by means of a swing over joint, from a basic position to the side of the seat to an end position that is located in front of the seat to form a leg rest, with the top or lateral surface of the supporting element in the basic position becoming the bottom surface thereof in the end position, has a displacement device, by means of which the end position of the supporting element can be displaced to a position in front of the seat or the base frame of the article of seating furniture beyond the position defined by the swing over joint.

16 Claims, 3 Drawing Sheets

ARTICLE OF FURNITURE AND FITTING FOR AN ARTICLE OF FURNITURE

CROSS REFERENCE TO RELATED APPLICATIONS

Figure 1:
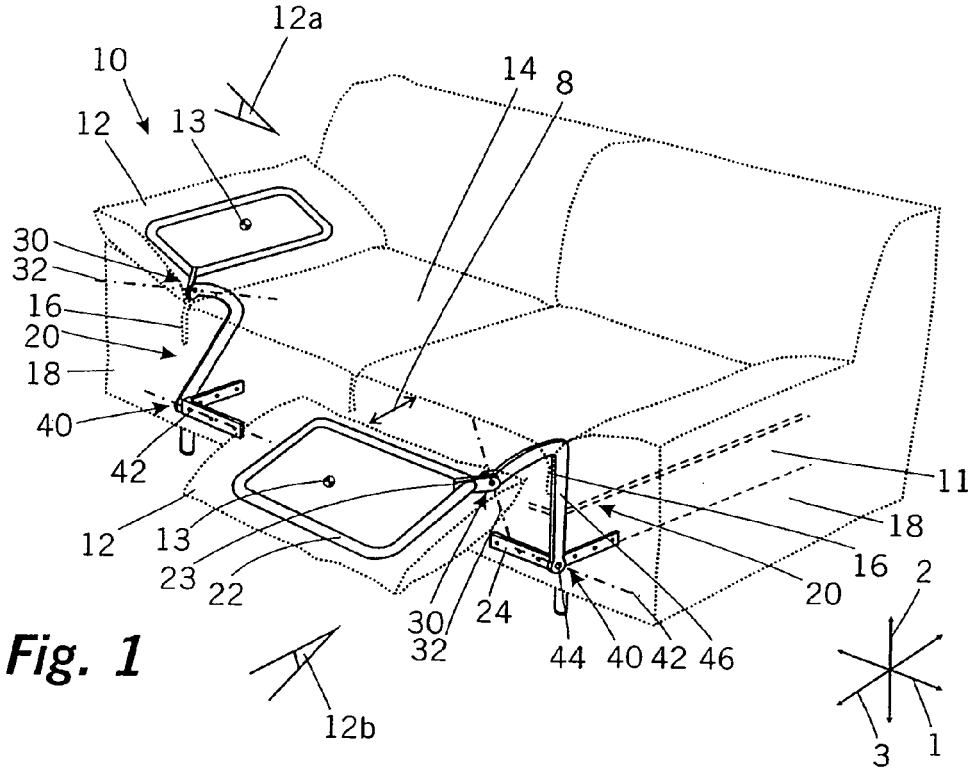

This application is a continuation of International Application No. PCT/EP2010/002579, with an international filing date of Apr. 27, 2010, the disclosure of which is hereby incorporated by reference herein.

The invention relates to a hinged fitting for an article of seating furniture, which hinged fitting serves to convert a supporting element, mostly a cushion, disposed, in a basic position, at the side of the seat, to a leg rest positioned in front of the seat, in the end position. The invention further relates to an article of seating furniture comprising a hinged fitting of the invention.

A hinged fitting of the generic kind provided in a corresponding article of seating furniture is disclosed in EP 0931484. In this case, a swing over joint is described which is located in the front corner region of the seat and enables a laterally disposed cushion to be moved over to form a leg rest. The advantages of this basic concept consist in simple and rapid operation and the fact that the top surface of the cushion, usually also used as a head rest, becomes the bottom surface of the cushion when used as a leg rest. However, it has proved to be a disadvantage that, in order to achieve a sufficient length of the leg-rest, the cushion in the laterally disposed state requires a width that is too expansive for commercially available upholstered furniture. Furthermore, for reasons of geometry, such a swing over joint is visible in its basic position in the front region of the furniture. Both disadvantages considerably restrict the use of the hinged fitting in upholstered furniture of an aesthetically very demanding nature.

It is therefore an object of the invention to provide a hinged fitting which can achieve the basic advantages of the concept described above without the drawbacks of the prior art and thus render the hinged fitting suitable for universal use.

This object is achieved in that the hinged fitting comprises a displacement device, with the aid of which the end position of the supporting element can be displaced beyond the position defined by the swing over joint in front of the seat or a base frame of the article of seating furniture. As a result, the length of the leg rest can assume very generous proportions even in the case of standard, compact dimensions of the supporting element.

The hinged fitting can be in the form of a coherent component. However, the term 'hinged fitting' may also include a fittings system, in which the hinged fitting is split up into separate component groups. Thus, for example, any one component group of such a set of component groups can form the swing over joint and another component group can form the displacement device. These can be separately attached to the fixing points of the article of seating furniture.

It is also possible to directly integrate the hinged fitting in a base frame of the article of seating furniture.

The references to movement of the supporting element relatively to the seat or the base frame of the article of seating furniture relate, in terms of the description of the fitting of the invention, to movements of parts of the hinged fitting that are intended for fixing the supporting element, the seat, and/or the base frame of the article of seating furniture and that can be displaced relatively to each other by means of the fitting in the manner described.

By means of the displacement device provided according to the invention, a spaced position of the supporting element can be achieved in front of the seat, which position allows a user seated on the sofa more room for his legs when the supporting element is being swung over, and also makes it easier for the user to stand up when the leg rest has been swung over. However, the displacement can also be carried out in cooperation with the seat itself relatively to a stationary base frame of the article of seating furniture so that the seat and the supporting element are in contact or approximately in contact with each other in the end position. Furthermore, the displacement proposed by the invention enables the fittings to be hidden completely in the basic position, which makes it possible to use the hinged fitting in a commercially available article of seating furniture of increased width. A further advantage is that the displacement device can displace the supporting element towards the front in a first phase of the movement of the supporting element from the basic position to the end position, even before the supporting element has pivoted via the swing over joint. As a result, it is possible to use particularly large supporting elements that protrude to the rear beyond the front side of the back rest, in the basic position. This can also be advantageous for aesthetic reasons.

The displacement device permits displacement of the supporting element or the relevant fixing elements of the hinged fitting to a degree that would not have been possible with the aid of the swing over joint alone.

The displacement device is advantageously designed to be rotative or translative. A rotative design is technically very simple and reliable. With the aid of such a rotative displacement device, the supporting element or the relevant fixing elements of the hinged fitting can be swivelled to a greater extent, in addition to their ability to pivot about the axis of the swing over joint.

A particularly advantageous form of displacement, in terms of geometry, can be achieved when the rotative displacement device has a rotation axis disposed below the surface of the seat, more particularly in the front region of the article of seating furniture located close to the floor and approximately parallel to the front surface of the seat. For this purpose, the hinged fitting must be preferably designed such that it can be mounted on the seat or the base frame of the article of seating furniture in such a way that the aforementioned alignment or position of the rotation axis of the displacement device can be achieved.

A translative design of the displacement device is advantageous for certain applications. In such a translative displacement device, the elements which are connected to the displacement device and can be moved relatively to each other by the displacement device are movable along a track, which is not defined by a swivel axis. This motion path can be straight or curved.

A translative displacement device preferably includes a rolling or sliding guide, which can be disposed, for example, on or in the seat, the base frame, or the supporting element or in the region of the fixing elements for the hinged fitting.

At the same time, the displacement device of the invention can also form, be part of, or be connected to, a shifting device for the seat.

In such an arrangement, the seat or the fixing elements for the hinged fitting provided for the seat, such as a seat frame, can be shifted, particularly together with the swing over joint, towards the front, more particularly with the aid of a rolling or sliding guide or shift levers. As a result, the seat moves to an extended functional position relative to the article of seating furniture.

The aforementioned rolling or sliding guide is preferably oriented approximately horizontally. The alternatively usable shift levers preferably consist of at least two shift levers with spaced apart swivel axes that jointly permit parallel or approximately parallel displacement of the seat. Deviation from parallelism makes it possible to swivel the seat in a manner that is ergonomically advantageous.

In a manner known per se, the back rest can also be coupled to the seat movement. For this purpose, the hinged fitting is designed such that it can also exert influence on the position of the back rest, and for this purpose comprises fixing elements for connection thereof to the back rest. Such a design provides many advantages particularly in terms of ergonomics and aesthetics.

In a further embodiment, the displacement device comprises a movable supporting arm. This supporting arm is movable relatively to the means for fixing the hinged fitting to the seat or the base frame of the article of seating furniture.

It can be disposed, on the one hand, between the swing over joint and the elements intended for attachment to the seat or the base frame of the article of seating furniture. In this case, it can be displaced by the displacement device towards the front in cooperation with the swing over joint. On the other hand, the supporting arm can be disposed between the swing over joint and the supporting element. In this case, the swing over joint can be disposed on the seat such that the swing over joint is stationary and the supporting element is displaced on the supporting arm. Both alternatives make for a simple, stable, and elegant implementation of the supporting arm.

Parts of the displacement device, particularly its supporting arm, are designed in a further embodiment to protrude from a slot located between the seat and an arm rest of the article of seating furniture, which arm rest is stationary relative to the seat or to the base frame of the article of seating furniture, or from a slot or opening in the top surface of the seat. The former option is, in particular, universally applicable, since this slot is already present in most forms of an article of seating furniture. The second option is practical for widespread forms of an article of seating furniture, particularly those that do not have a separate side element.

Alternatively, the displacement device may be provided in the form of a lateral end of the article of seating furniture. In such a case, the displacement device is not hidden, but is on the contrary intentionally made visible in order to highlight its mode of operation.

In a further embodiment, one or more joints of the hinged fitting are designed such that the parts that are moved thereby relatively to each other are supported against each other directly or by means of an axial bearing. In such a design, the bending moments are thus not transferred primarily by means of a radial bearing, for example, to an axle element. Instead, the sections that can move relatively to each other via the joint are pressed together with the aid of a tightening device such as a bolt in order to achieve a transfer of bending moments, which is substantially not effected by the bolt. This represents a so-called axial bearing and is a particularly space-saving and advantageous solution compared with a radial bearing.

Furthermore, the hinged fitting preferably comprises at least two, in particular internal, end stops, one of which limits the mobility of the swing over joint and the other limits the mobility of the displacement device in the end position. This end position is thus precisely defined and a risk of injury is effectively prevented. Furthermore, end stops may be provided for each of the two directions of movement of the swing over joint and/or the displacement device, this being achievable by means of one end stop acting in two directions or by means of two separate end stops each acting in only one direction. This bidirectional design of the stop members is advantageous since it can define the position of the supporting element both in the basic position and in the end position. Thus, when the supporting element is moved away from the end position, it is especially possible to prevent the creation of an unwanted alternative basic position, in which either the swing over joint or the displacement device has been moved beyond the intended basic position, while the other element has not reached its intended basic position.

The hinged fitting may be supplemented by an angle adjusting device. The latter can be formed, in particular, as a friction device or a latching device known per se that can then be advantageously disposed between the supporting members for the supporting element and the swing over joint. In addition to the movements of the swing over joint and the displacement device, the angle adjusting device permits movement of the supporting element or at least parts thereof. As a result, the supporting element or the relevant fixing elements can be pivoted in the basic position of the hinged fitting, in which the supporting element is disposed at the side of the article of seating furniture, completely or partially relative to the other parts of the hinged fitting, particularly about a swivel axis extending from the front to the back relative to the article of seating furniture so that the supporting element can perform its function as an arm rest in the basic position in a particularly advantageous manner as regards aesthetics. The angle-adjusting device also makes it possible to use the supporting element in different states of use in the basic position of said supporting element.

In the case of an angle adjusting device acting only partially on the position of the supporting element, the angle adjusting device can preferably connect a plurality of supporting members for the supporting element or the relevant fixing elements of the fitting to each other for movement relatively to one another in order to advantageously achieve a very flexible adjustable form of the supporting element.

The displacement device of the hinged fitting is preferably designed to lower the level of the end position of the supporting element as compared with that of the basic position thereof. The displacement device is therefore designed such that, starting from an already pivoted swing over joint, the displacement of the supporting element to the fully executed end position is accompanied by lowering of the supporting element. Such a design is advantageous, on the one hand, because a lowered leg rest is desirable for ergonomic reasons. Furthermore, the lowering of the supporting element and thus of its end position can be achieved automatically due to the weight of the supporting element.

Furthermore, it is advantageous when the hinged fitting comprises fixing elements for a wooden board or a wooden frame to be disposed in the supporting element, the fixing elements being flange parts, in particular, which are provided for two-sided clamping of, and/or for fixation by screwing of, a wooden board or a wooden frame. The use of such a wooden board and a hinged fitting suitable therefor is advantageous, since such a wooden board can be upholstered very easily and, in the case of such a design of the hinged fitting, the latter need not be adapted to the size of the supporting element as used in individual cases. Instead, it is designed to accommodate boards of any size and is thus suitable for universal use.

The invention further relates to an article of seating furniture, more particularly a sofa, comprising a base frame that is stationary relative to an underlying surface, a seat, and a supporting element, the latter being capable of pivoting, by way of a hinged fitting comprising a swing over joint, from a basic position disposed laterally relative to the seat to an end position to form a leg rest disposed in front of the seat, the top or lateral surface of the supporting element in the basic position becoming the bottom surface of the supporting element in the end position.

According to the invention, the hinged fitting of such an article of furniture of the generic kind is designed in accordance with a hinged fitting of the type described above. At least one of the hinged fittings described is used in such an article of seating furniture of the invention. Preferably, two hinged fittings of the invention allowing for independent displacement of two supporting elements are used in the case of a sofa.

With respect to the embodiment comprising at least one hinged fitting and its attachment to the other components of the article of seating furniture, all of the variants of the hinged fitting of the invention described above are conceivable.

Particularly as a development of the aforementioned article of seating furniture of the invention, the invention further relates to an article of seating furniture of the generic kind in which the hinged fitting is designed such that the supporting element is disposed at a distance from the seat in the end position and/or the swing over joint is disposed on the reverse side of a front edge of the seat at least in the basic position.

In this case, it is particularly advantageous when the displacement device is formed and disposed relative to a centre of gravity of the supporting element such that when the supporting element is pivoted about an axis of the swing over joint starting from the basic position, the displacement device will assume its end position, and when the supporting element is pivoted about the axis of the swing over joint starting from its end position, the displacement device will assume its basic position.

In such a design, pivoting at the swing over joint thus also controls the displacement device by utilizing the centre of gravity of the supporting element. When the supporting element is pivoted in the direction of its end position, the centre of gravity of the supporting element acts so as to urge the displacement device into its end position, for example, since the centre of gravity is then positioned in front of a rotation axis of a rotative displacement device. When the supporting element is then pivoted back in the direction of the basic position with the aid of the swing over joint, the displacement device is also moved back in the direction of the basic position since the centre of gravity is then located behind the rotation axis, for example.

Such designs can be particularly well achieved with the aid of a hinged fitting of the invention. Basically, however, these also include embodiments of a sofa having the aforementioned features, in which the hinged fitting achieves displacement of the supporting element with the aid of the swing over joint alone.

The advantage of causing the supporting element to be at a distance from the seat in its end position is that a particularly long supporting surface is achieved without strictly necessitating a particularly large supporting element for this purpose. Instead, as a result of the distance of the supporting element between an edge of the supporting element oriented towards the side of the seat and an edge of the seat oriented towards the supporting element, which distance is preferably at least 5 cm and more preferably 15 cm, a spaced supporting surface is jointly provided by the seat and the supporting element. The space does not prove to be an encumbrance in practice. This space is comparable to that usually arising when a separate footstool is placed in front of the seat.

The arrangement of the swing over joint on the reverse side of a front edge of the seat keeps the swing over joint hidden from view, for aesthetic reasons, for one reason. Furthermore, as a result of such an arrangement, in which the axis of the swing over joint is preferably rearwardly displaced at the swing over joint by at least 5 cm relative to the front edge of the seat in the longitudinal direction of the article of furniture, the risk of injury posed by the hinged fitting, particularly the swing over joint, is reduced. In such a back-shifted arrangement of the swing over joint, it is particularly advantageous to provide a displacement device of the type described above on the hinged fitting. However, designs not having such a displacement device are also possible, a supporting arm being preferably rigidly attached to the supporting element in such designs, which supporting arm connects the swing over joint to the supporting element and has a length corresponding to at least the distance by which the swing over joint is shifted away from the front edge of the seat.

The articles used in this document should not be understood to mean numerals and can denote, like the nouns, the singular and plural forms in individual cases. Terms denoting location such as 'in front of the seat' or 'at the side of the seat' are to be understood in the conventional sense, that is to say, from the point of view of a user standing in front of or seated on the article of seating furniture.

Figure 2:
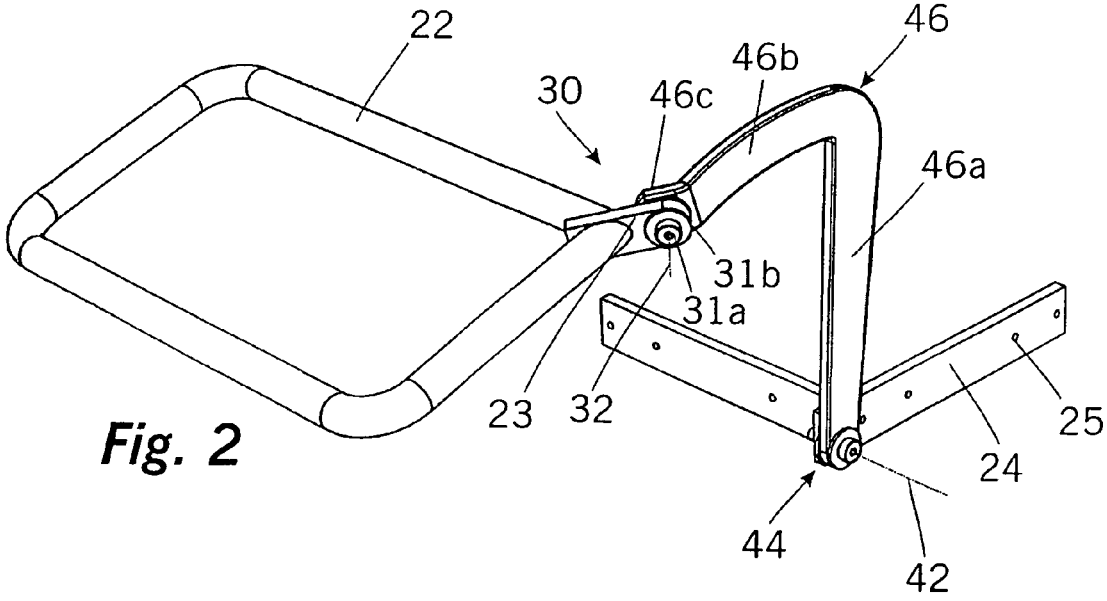
Figure 3A:
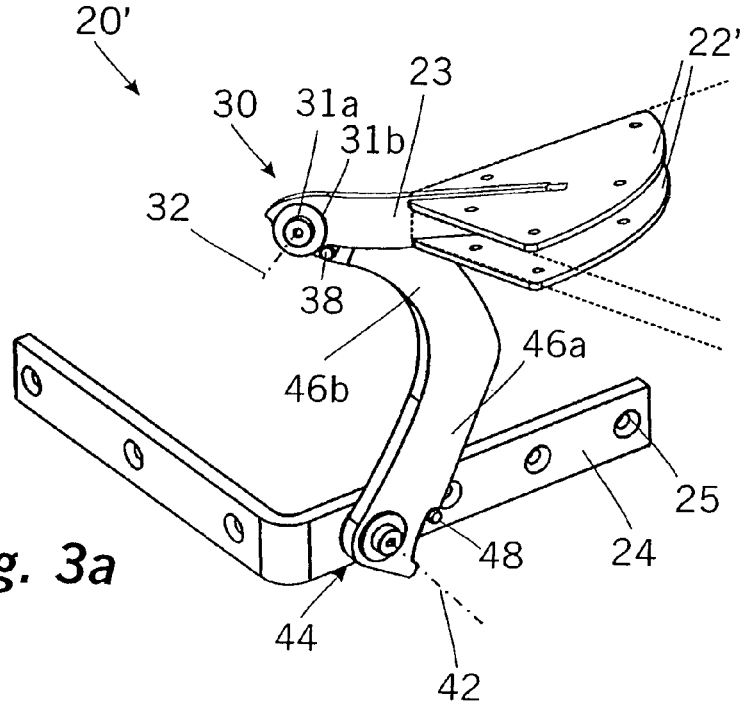
Figure 3B:
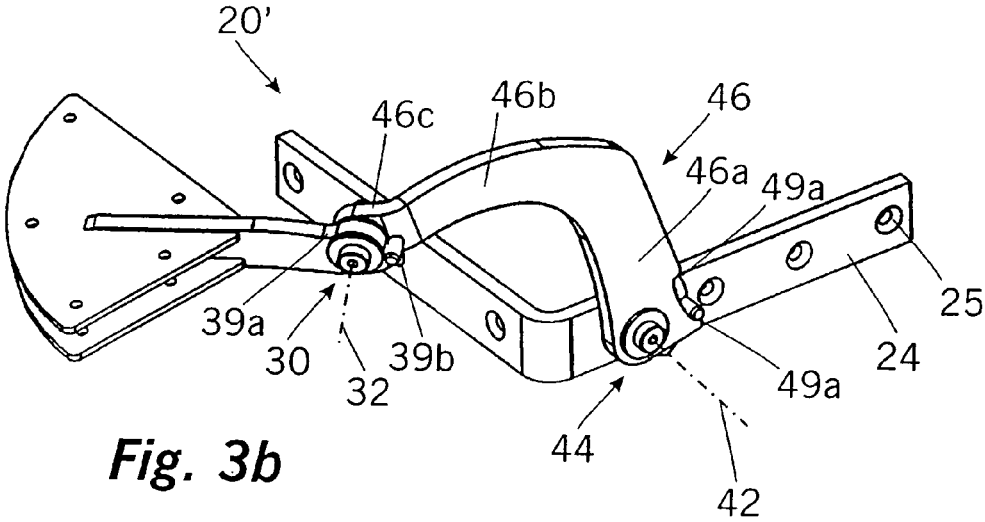
Figure 4:
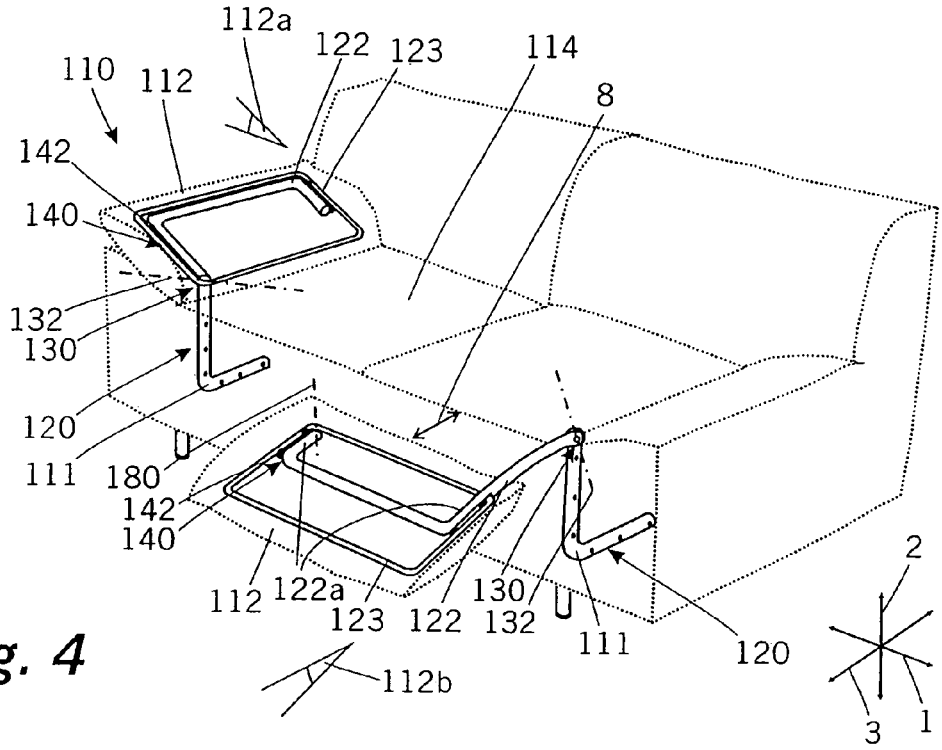
Figure 5:
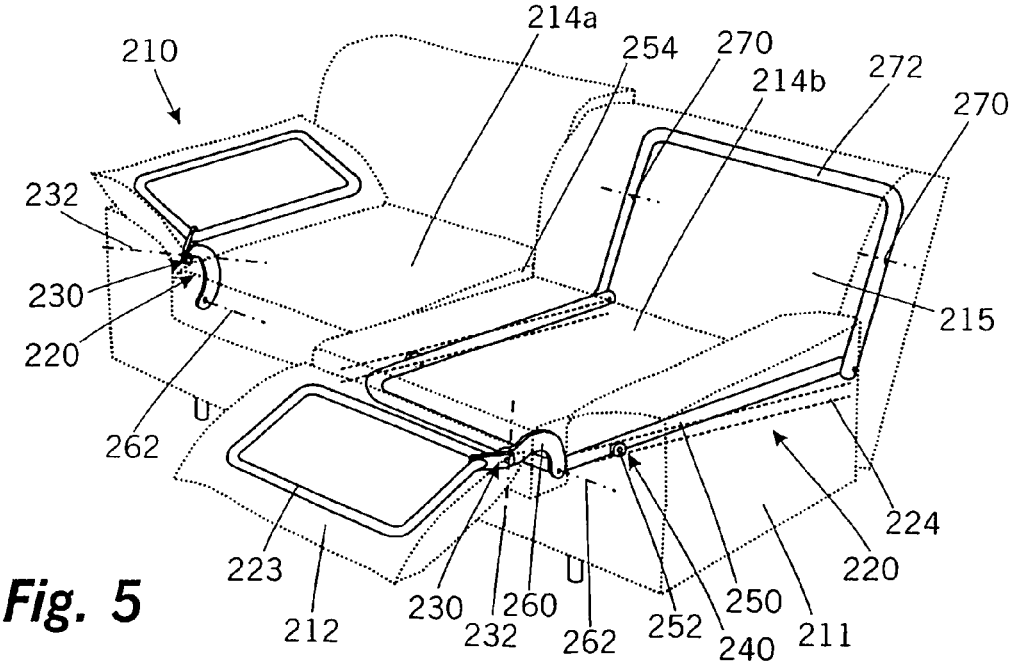

The invention is described in greater detail below with reference to the drawings, in which:

FIG. 1 is a perspective view of a hinged fitting of the invention, installed in a sofa of the invention, FIG. 2 shows a hinged fitting of the sofa shown in FIG. 1, on a larger scale, FIGS. 3*a* and 3*b* show a modified variant of the hinged fitting shown in FIG. 2, on a larger scale, FIG. 4 is a view, comparable to FIG. 1, of a second sofa of the invention, and FIG. 5 is a view, comparable to FIG. 1, of a third sofa of the invention.

FIG. 1 shows an article of seating furniture of the invention in the form of a sofa 10. This article of seating furniture 10 comprises two supporting elements 12 that can be moved from a basic position, in which they are disposed as cushions located at the side of a seat 14, to an end position, in which they form a leg rest in front of the seat 3 [sic: 14].

A first hinged fitting 20 can be seen on the right-hand side of the sofa together with the supporting element 12 attached thereto in its opened end position. On the left-hand side of the sofa, a second hinged fitting 20, which is laterally inverted but structurally identical in other respects, can be seen with the supporting element 12 attached thereto in its closed basic position.

The hinged fittings 20 each comprise a swing over joint 30, by means of which the respective supporting element 12 can be swung from the basic position to the end position. The axes 32 of the swing over joints 30 are located obliquely in space. In the embodiment shown in FIG. 1, the swing over joints 30 and thus the axes 32 are not fixed in position relatively to the seat 14 of the article of furniture, as explained in more detail below.

The intended position and/or orientation of the axes 32 in space depends on the desired angles 12*a*, 12*b*, at which the supporting elements 12 are to be inclined in the basic and end positions relative to an imaginary horizontal plane.

On the side remote from the seat 14, the hinged fittings 20 each have supporting members 22, 23, which serve to support the supporting element. In the embodiment shown in FIG. 1, these supporting members consist of a supporting frame 22, which is attached to the swing over joint 30 with the aid of a flange element 23 permanently attached to the supporting frame 22. The supporting frame 22 and the flange element 23 are thus jointly movable relatively to the parts of the hinged fitting 20 on the opposite side of the swing over joint 30.

In alternative variants (not shown in FIG. 1), the supporting members may be in the form of struts or plates.

A rotative displacement device 40 is provided as a central element of each hinged fitting 20 in addition to the swing over joint 30. This displacement device 40 comprises a movable supporting arm 46, to the end of which (lower end in FIG. 1) a rotary joint 44 is provided, with the aid of which the supporting arm 46 can pivot about a rotation axis 42 relatively to a flange member 24. This flange member 24 is fixed to a frame 11 (indicated by dashed lines) of a base frame of the article of furniture 10, for example, by means of screw connections. Mounting the flange member 24 on this frame 11 preferably composed of boards, more particularly wooden boards, results in a very simple construction combined with a high degree of stability.

The rotation axes 42 of the displacement device 40 extend into the interior of the article of furniture 10 in the front region thereof close to the floor and preferably substantially parallel to a transverse axis 1 of the article of furniture, which transverse axis 1 extends in the direction of the seat width. Depending on the type of furniture, the rotation axis 42 can be advantageously inclined at an angle of up to 30° relative to the furniture transverse axis 1.

The rotation axis 42 can also be disposed at a higher level, more particularly at an upper edge of the frame 11. In such a case, a larger pivoting angle of the supporting arm 46 about the rotation axis 42 is necessary for the same degree of horizontal displacement as given in the embodiment illustrated.

With the exception of the components that are fixed to the frame, in this case the flange member 24, all parts of the hinged fitting can pivot together with the supporting arm 46 about the rotation axis 42. The swing over joint 30 with the supporting members 22, 23 located on the side near the supporting elements, and the supporting element 12 can thus also be pivoted by means of a swivel movement in a horizontal or descending arc of a circle by means of the supporting arm 46 toward the front and thus away from the seat 12 [sic: 14].

As a result of this swivel movement made possible by the displacement device 40, a space 8 can be formed in the end position shown on the right-hand side in FIG. 1, which space is disposed between the front edge of the seat 14 and the edge of the supporting element 12 oriented toward a seated person.

In this end position, the supporting element 12 is thus comparable to a footstool disposed in front of an article of furniture, but with the advantage that the supporting element 12 can at any time be returned back to the basic position shown on the left-hand side of FIG. 1.

Apart from this ergonomic quality, the displacement device 40 also causes the swing over joint 30 to be disposed behind the front edge of the seat 14 and thus to be completely hidden in the basic position of the hinged fitting 20 shown on the left-hand side of the figure. Only the displacement device 40 brings the swing over joint into a position disposed in front of this forward edge.

Furthermore, it is of particular advantage in terms of ergonomics that the centre of gravity 13 of each of the two supporting elements 12 is disposed behind the respective rotation axis 42 when the supporting element has not yet been pivoted about the respective axis 32, and in front of the respective rotation axis 42 when the supporting element 12 has been pivoted about the axis 32. As a result, it is not necessary to exert manual influence on the displacement device 40, since displacement thereof is effected virtually automatically: Depending on the angular position of the swing over joint 30, the displacement device 40 will assume the position shown on the left-hand or right-hand sides of FIG. 1 respectively.

This also causes the displacement device 40 and the supporting element 12 to remain in either position without springs or latching elements being necessary for this purpose.

The supporting arm 46 has an angular and/or curved shape. A part of the supporting arm 46 that is remote from the rotary joint 44 extends at an approximately equal distance from the rotation axis 42 so that when the supporting element 12 is transferred to the end position shown in the right half of FIG. 1, observation thereof from outside will not necessarily reveal that the displacement device 40 is in the form of a rotative displacement device.

It is of particular advantage that the displacement device 40, particularly the supporting arm 46 of the displacement device 40, can be moved exclusively in the plane of the vertical axis 2 of the article of furniture and its longitudinal axis 3 so that it can be moved in a vertical slot 16, which is in any case provided between the seat 14 and an arm rest 18.

In certain forms of seating furniture, more particularly seating furniture not having an arm rest (not illustrated), a sensible solution may be to guide the supporting arm through an opening in the front part of the seat surface. It may also be advantageous to move the supporting arm at the side of the seat, thus making the supporting arm and its mode of operation clearly visible.

In a variant (not illustrated) of the embodiment shown in FIG. 1, the displacement device is replaced by a translative displacement device. In this case, the supporting arm is again provided, but it is mounted for translative movement relative to the base frame of the article of furniture, more particularly by means of a sliding or rolling guide. The track along which the supporting arm is guided is preferably of a curved form, in order to approximately replicate the movement of the swing over joint 30 described with reference to FIG. 1, in which the supporting element descends towards the end position. This translative variant of the hinged fitting takes up less space in the vertical direction 2 of the furniture so that it can be advantageously provided in, say, furniture having longer legs than the furniture shown in FIG. 1, in which case a displacement device extending almost down to the floor would prove to be an encumbrance.

FIG. 2 shows the hinged fitting 20 comprising the rotative displacement device 40 shown in FIG. 1, on a larger scale.

The flange element 24 is intended to be fixed to the base frame of the article of furniture. Fixing bores 25, more particularly for screws, are provided on the flange element 24 for this purpose. The other parts of the hinged fitting 20 can be pivoted at the swing over joint 44 relatively to the flange element 24 about the rotation axis 42. The supporting arm 46, which has a preferably rectangular cross-section and comprises a first portion 46*a* extending in the radial direction and a curved second portion 46*b* extending equidistant from the rotation axis 42, is directly connected to the rotary joint 44. The swing over joint 30, which allows the supporting element 12 to pivot about the axis 32 relatively to the supporting arm 46, is provided at a bent-over end portion 46*c* of this second portion 46*b* of the supporting arm 46. The swing over joint 30 is provided, for this purpose, between the supporting arm 46 and the supporting members 22, 23 which serve to support the supporting element 12. These supporting members are the flange element 23 and the supporting frame 22. The desired alignment of the axis 32 is achieved by the angle of bend of the end 46*c* of the supporting arm 46.

The swing over joint 30 and the rotary joint 44 comprise an axial bearing, which is formed in that a tightening bolt 31*a* presses together the front surface of the bent end portion 46*c* of the supporting arm 46 and that of the flange element 23 via a friction washer 31*b*. This axial bearing is thus protected by these front surfaces from bending stresses. This axial bearing can be particularly short in the direction of its bearing axis 32 and is therefore very well-suited for being mounted in the corner region of the supporting element 12.

Both joints 30, 44 are equipped with an internal stop for the end positions. For this purpose, one front surface has an arc-shaped groove, which is hidden to prevent the risk of injury and is engaged by a bolt disposed on the other front surface.

Like FIG. 2, FIGS. 3*a* and 3*b* show a hinged fitting 20', which differs from the hinged fitting 20 shown in FIG. 2 only in terms of certain details and is therefore provided with corresponding reference numerals.

Unlike the hinged fitting 20, the hinged fitting 20' does not have a supporting frame 22. Instead, two holding plates 22' having bores for screws are provided on the flange element 23. These holding plates serve to accommodate a board, for example, a wooden board indicated by the dashed lines in FIG. 3*a*. Such a board can be upholstered relatively easily. Furthermore, the advantage of such a hinged fitting 20' comprising holding plates 22' consists in the ability to use the same hinged fitting irrespective of the size of the supporting element 12, since this hinged fitting does not include any components that depend on the size of the supporting element. Such a hinged fitting 20' is thus suitable for universal use.

Furthermore, the hinged fitting 20' differs from the hinged fitting 20 with respect to the design of the stop. Bolts 38, 48 are provided both on the flange element 24 and on the supporting arm 46 eccentrically to the joints 30, 44, which bolts 38, 48 cooperate with stop surfaces 39*a*, 39*b* and 49*a*, 49*b* respectively so that the mobility of the flange element 23 relative to the supporting arm 46 is restricted bi-directionally, just as the mobility of the supporting arm 46 relative to the flange element 24. The bi-directional restriction means that both the basic position and the end position of the hinged fitting 20' are clearly defined and are not determined by the other sofa parts attached to the hinged fitting 20'.

In a further embodiment of the article of furniture 110 of the invention shown in FIG. 4 comprising a hinged fitting 120 of the invention, a translative displacement device 140 is provided instead of the rotative displacement device.

The article of furniture shown in FIG. 4 comprises a swing over joint 130 for each hinged fitting 120, which swing over joint is stationarily fixed relatively to a component (illustrated only partially) of the base frame 111 of the article of furniture 110. This swing over joint 130 allows the remaining parts of the hinged fitting 120 and thus also a supporting element 112 to pivot about an axis 132, which, in turn, is disposed obliquely in space and extends substantially in the plane of the longitudinal direction 3 of the furniture and the transverse direction 1 thereof. A supporting arm 122 that is part of the displacement device 140 is provided beyond the swing over joint 130. This displacement device 140 is provided as a translative displacement device and has, for this purpose, a rolling guide 142 provided between the supporting arm 122 and a supporting frame 123 serving to support the supporting element 112. The rolling guide 142 is disposed inside the supporting element 112 and is thus completely hidden from view.

The displacement device 140 allows for displacement of the supporting element 112 relative to the approximately J-shaped supporting arm 122. This displacement takes place in the direction of extension of two parallel portions 122*a* of the supporting arm 122. During this displacement, the supporting frame 123 fixed to the supporting element is moved relatively to the supporting arm 122, and a portion of the supporting arm 122 protrudes from the supporting element 112 when the supporting element 112 is displaced towards the front, so that a space 8 is again achieved between the front edge of the seat 114 and the edge of the supporting element 112 oriented towards a seated person.

Similarly to the embodiment shown in FIG. 1, this second embodiment also does not necessitate any separate manipulation of the displacement device 140. Due to the angles 112*a*, 112*b*, by which the supporting element 112 and thus also the rolling guide 142 are inclined in relation to a horizontal plane in the basic position shown in the left half of the figure and in the end position shown in the right half of the figure, a manual pivoting movement of the supporting element 112 about the axis 132 results in an automatic downward displacement of the supporting element 112 in relation to the supporting arm 122.

As can be seen on the left-hand side of the article of furniture shown in FIG. 4, all parts of the hinged fitting 120 in this basic position are hidden in the seat or in or below the supporting element 112.

In a variant (not illustrated), the translative displacement device 140 is replaced by a rotative one. Instead of the rolling guide 142, a rotary joint might be provided for this purpose, for example. In this case, a rotation axis 180 of this rotary joint would pivotally connect a front end of the supporting arm 122 with the supporting frame 123. The supporting element 112 can then pivot about this rotation axis 180 along the supporting arm 122 towards or away from the swing over joint 130, and thus perform the displacement proposed by the invention. With reference to the illustration in FIG. 4, the supporting element would be pivoted, for example, by approximately 15° in the clockwise direction about the rotation axis 180 after the swing over joint 130 has been moved to its end position in order to thus achieve the illustrated end position of the supporting element.

FIG. 5 shows another embodiment of the article of furniture 210 of the invention comprising hinged fittings 220 of the invention. The hinged fitting 220 is again in the form of a hinged fitting 220 having a translative displacement device 240, but its special feature is that the displacement device 240 simultaneously represents a shifting device for each seat 214*a*, 214*b* of the article of furniture 210. For this purpose, the seat 214*b* is stationary relative to a seat frame 250. With the aid of a rolling guide 252, this seat frame 250 is displaceable in the longitudinal direction 3 of the article of furniture relatively to a stationary base frame 211 of the article of furniture 210 and guide rails 224 disposed on the base frame. Alternatively to such a rolling guide 252, other displacement mechanisms for the seat frame 250 are also possible, such as a sliding guide or a linkage to rocker arms, which are articulated to the base frame at one end and to the seat frame the other.

The rolling guide 252 or an alternative displacement mechanism is preferably formed such that a displacement of the seat frame 250 towards the front simultaneously involves a slight tilting movement, as indicated in FIG. 5 by the difference in level 254.

A swing over joint 230 is attached to the seat frame 250, which swing over joint permits pivoting of the supporting element 212 about an obliquely disposed axis 232 in a manner similar to the preceding embodiments.

In the embodiment illustrated, the swing over joint 230 is not permanently attached to the seat frame 250, but instead is fixed to an intermediate element 260, which, in turn, is linked to the seat frame 250 for rotation about a rotation axis 262. The advantage of this intermediate element 260 is that it allows the swing over joint 230 to be particularly well hidden in this basic position, as illustrated on the left-hand side of the article of furniture in FIG. 5.

A particularly simple design is achieved when the swing over joint 230 of a variant (not illustrated) is stationary relative to the seat frame 250, and thus permanently attached thereto.

Unlike the preceding embodiments, there is no space between the seat 214*b* and the supporting element 212 created by the displacement device 240 in this embodiment. Nonetheless, the leg-supporting element length achieved is large due to the displacement of the seat 214*b* to the front, since the seat 214*b* is connected to the hinged fitting 220.

As a result of the inclusion of a back rest frame 272 articulated to the seat frame 250 by means of joints 270 in the hinged fitting 220, coupling of the back rest 215 to the displacement device 240 is additionally achieved.

In a variant (not illustrated) of the embodiment shown in FIG. 1, the fitting 20 remains unchanged, although the seat is displaceable in the manner of the rolling guide 252 so that the supporting element 12 and the seat 14 can be displaced independently of each other. An additional variant based thereon is also possible by means of a slight modification of the hinged fitting 20 shown in FIG. 1, by coupling the movement of the seat 14 to that of the supporting element 12 in that, for example, an extension attached to the portion 46*a* of the supporting arm 46 engages the frame of the displaceable seat.

The invention claimed is:

1. A hinged fitting for an article of seating furniture having a seat, comprising a swing over joint, wherein a supporting element can be swung by said swing over joint from a basic position disposed lateral to the seat to an end position disposed in front of the seat to form a leg rest, a top surface or lateral surface of said supporting element in the basic position becoming a bottom surface thereof in said end position;

wherein said hinged fitting comprises a displacement device, and said end position of said supporting element can be moved by said displacement device in front of the seat or in front of a base frame of said article of seating furniture beyond a position defined by said swing over joint; and wherein said displacement device has a movable supporting arm which is positioned between said swing over joint and said seat or said base frame of said article of seating furniture.

2. The hinged fitting for an article of seating furniture as defined in claim 1, wherein said displacement device is designed for rotation and has a rotation axis which is disposed in a region below a front seat edge at an angle of from 0 to 30 degrees to a direction of a seat width.

3. The hinged fitting for an article of seating furniture as defined in claim 1, wherein part seating furniture as defined in claim s of said displacement device are designed to project from a slot located between said seat and an arm rest of said article of seating furniture, from a top surface of said seat or from said arm rest.

4. The hinged fitting for an article of 1, wherein said hinged fitting is supplemented by an angle adjusting device for varying an angle of said supporting element or parts of said supporting element with reference to a plane of the seat, at least in the basic position.

5. The hinged fitting for an article of seating furniture as defined in claim 1,wherein said displacement device of said hinged fitting lowers a level of the end position of said supporting element in relation to the basic position of said supporting element.

6. A hinged fitting for an article of seating furniture having a seat, comprising a swing over joint, wherein a supporting element can be swung by said swing over joint from a basic position disposed lateral to the seat to an end position disposed in front of the seat to form a leg rest, a top surface or lateral surface of said supporting element in the basic position becoming a bottom surface thereof in said end position;

wherein said hinged fitting comprises a displacement device, and said end position of said supporting element can be moved by said displacement device in front of the seat or in front of a base frame of said article of seating furniture beyond a position defined by said swing over joint; and wherein said displacement device has a movable supporting arm which is disposed between said swing over joint and elements provided for attachment of said supporting element.

7. A hinged fitting for an article of seating furniture having a seat, comprising a swing over joint, wherein a supporting element can be swung by said swing over joint from a basic position disposed lateral to the seat to an end position disposed in front of the seat to form a leg rest, a top surface or lateral surface of said supporting element in the basic position becoming a bottom surface thereof in said end position;

wherein said hinged fitting comprises a displacement device, and said end position of said supporting element can be moved by said displacement device in front of the seat or in front of a base frame of said article of seating furniture beyond a position defined by said swing over joint; and wherein said displacement device is designed for translative movement and has a rolling or sliding guide designed for accommodation thereof in said seat, in said base frame, or in said supporting element.

8. A hinged fitting for an article of seating furniture having a seat, comprising a swing over joint, wherein a supporting element can be swung by said swing over joint from a basic position disposed lateral to the seat to an end position disposed in front of the seat to form a leg rest, a top surface or lateral surface of said supporting element in the basic position becoming a bottom surface thereof in said end position;

wherein said hinged fitting comprises a displacement device, and said end position of said supporting element can be moved by said displacement device in front of the seat or in front of a base frame of said article of seating furniture beyond a position defined by said swing over joint; and wherein said displacement device acts as a shifting device for said seat, forms part of said shifting device, or is combined with said shifting device, wherein a movable back rest is also coupled to said shifting device.

9. The hinged fitting for an article of seating furniture as defined in claim 8, wherein said swing over joint is attached to said seat or to a seat frame, said seat or said seat frame being capable of being moved by said shifting device, said swing over joint being attached to said seat or said seat frame by an intermediate element.

10. A hinged fitting for an article of seating furniture having a seat, comprising a swing over joint, wherein a supporting element can be swung by said swing over joint from a basic position disposed lateral to the seat to an end position disposed in front of the seat to form a leg rest, a top surface or lateral surface of said supporting element in the basic position becoming a bottom surface thereof in said end position;

wherein said hinged fitting comprises a displacement device, and said end position of said supporting element can be moved by said displacement device in front of the seat or in front of a base frame of said article of seating furniture beyond a position defined by said swing over joint; and wherein said hinged fitting has at least two end stop members, a first one of said at least two end stop members restricting movement of said swing over joint and a second one of said at least two end stop members restricting movement of said displacement device in said end position, each of said end stop members limiting movement of said displacement device in two opposite directions or in only one direction.

11. A hinged fitting for an article of seating furniture having a seat, comprising a swing over joint, wherein a supporting element can be swung by said swing over joint from a basic position disposed lateral to the seat to an end position disposed in front of the seat to form a leg rest, a top surface or lateral surface of said supporting element in the basic position becoming a bottom surface thereof in said end position;

wherein said hinged fitting comprises a displacement device, and said end position of said supporting element can be moved by said displacement device in front of the seat or in front of a base frame of said article of seating furniture beyond a position defined by said swing over joint; and wherein said hinged fitting comprises fixing elements for mounting a wooden board or a wooden frame in said supporting element, said fixing elements being flange elements provided for two-sided clamping and/or fixation by screwing of the wooden board or wooden frame in said supporting element.

12. A fittings system for an article of seating furniture having a seat, the fitting system comprising:

a first fixing element attached to said seat or to a base frame of the article of seating furniture, a second fixing element attached to a supporting element, and a swing over joint between said first fixing element and said second fixing element;

wherein said fittings system is designed to move said supporting element mounted on said second fixing element from a basic position in which said supporting element is disposed lateral to said seat to an end position in which said supporting element is disposed in front of said seat to form a leg rest, wherein the fittings system is designed such that a lateral or top surface of said supporting element in the basic position becomes a bottom surface of said supporting element in the end position, and a displacement device is located between said first fixing element and said second fixing element in addition to said swing over joint, said displacement device effecting, during movement of said supporting element from the basic position to the end position, additional displacement of said supporting element away from said seat beyond the degree of displacement of said supporting element that can be obtained by a swinging movement of said swing over joint.

13. The fittings system as defined in claim 12, wherein said displacement device:

is provided between said first fixing element and said swing over joint such that said swing over joint can be displaced together with said second fixing element by said displacement device, or is provided between said swing over joint and said second fixing element such that said displacement device can be displaced together with said second fixing element by said swing over joint.

14. The fittings system as defined in claim 12, wherein said displacement device:

is designed for rotary displacement of said second fixing element, or is designed for translative displacement of said second fixing element.

15. The fittings system as defined in claim 12, wherein said displacement device is designed for translative displacement of said supporting element, and said displacement device is provided for positioning thereof in a region of said seat and/or of said base frame of said article of seating furniture or for positioning in said supporting element.

16. The fittings system as defined in claim 12, wherein said displacement device is designed for joint displacement of said second fixing element and said seat relative to said base frame, for said first fixing element is designed for attachment to said frame of said article of seating furniture, and said fittings system has at least a third fixing element for attachment thereof to said seat, said displacement device being provided between said first fixing element and said third fixing element.

* * * * *